United States Patent [19]

Tang

[11] Patent Number: 5,027,125

[45] Date of Patent: Jun. 25, 1991

[54] SEMI-ACTIVE PHASED ARRAY ANTENNA

[75] Inventor: Raymond Tang, Fullerton, Calif.

[73] Assignee: Hughes Aircraft Company, Los Angeles, Calif.

[21] Appl. No.: 394,467

[22] Filed: Aug. 16, 1989

[51] Int. Cl.[5] ..... H01Q 3/26

[52] U.S. Cl. ..... 342/368; 342/374

[58] Field of Search ..... 342/368, 374; 330/289

[56] References Cited

U.S. PATENT DOCUMENTS 4,124,852 11/1978 Steudel .
4,682,176 7/1987 Jones .
4,766,438 8/1988 Tang .
4,791,421 12/1988 Morse et al. .

*Primary Examiner*—Thomas H. Tarcza
*Assistant Examiner*—Mark Hellner
*Attorney, Agent, or Firm*—W. K. Denson-Low

[57] ABSTRACT

A module disposed at each radiating element of a phased array antenna, the module having a limiter, a low-noise amplifier and a phase shifter. One embodiment includes a DPDT switch to permit use of a common phase shifter on transmit and receive. On transmit, the DPDT switch is thrown in a position that connects the phase shifter directly to the radiating element. On receive, the DPDT switch is thrown in a position that connects the radiating element through the limiter and low noise amplifier and then to the phase shifter. Another embodiment uses a four-port circulator in place of the DPDT switch, and uses separate phase shifters for transmit and receive. A semi-active module for a constrained feed array uses both a DPDT switch and a circulator and uses a common transmit/receive phase shifter. A semi-active module for a space-fed array uses two DPDT switches, a single phase-shifter and limiter/-low-noise amplifier and two antenna elements; one of receive, and one for retransmit. Another module employs a four-port circulator, separate transmit and receive phase shifters, and separate transmit and receive beamforming networks. In a monopulse radar transmitter, a module using a four-port circulator and a separate receive diode phase shifter, limiter and low-noise amplifier is used with a receive monopulse feed, transmit ferrite phase shifters and a transmit series feed.

24 Claims, 3 Drawing Sheets

SEMI-ACTIVE PHASED ARRAY ANTENNA

BACKGROUND

The present invention relates to phased array antennas, and more particularly, to a semi-active phased array antenna.

The two basic types of phased array antennas are the active phased array antenna and the passive phased array antenna. A passive phased array antenna has a single, centralized transmitter and receiver connected to the feed line to the antenna. The active phased array antenna provides a separate high power amplifier and a low-noise receiver amplifier at each radiating element.

Currently, the cost of a passive phased array antenna is an order of magnitude lower than that of an active phased array antenna. For example, the cost of a phase shifter module in a passive phased array antenna is approximately $200 compared to $8,000 for an active transmit and receive module in an active phased array antenna. The disadvantage of the passive phased array antenna is the additional ohmic loss between the transmitter/receiver and the radiating aperture due to the beam forming feed and phase shifters. The disadvantage of the active phased array antenna is the high cost of the solid state high-power amplifiers in the active modules.

Accordingly, it is a feature of the present invention to provide a semi-active phased array antenna which provides high power in transmit mode and a low noise figure in receive mode.

SUMMARY OF THE INVENTION

In accordance with this and other features and advantages of the present invention, there is provided a plurality of antenna elements that are subdivided into groups of elements forming sub-arrays of antenna elements. Each antenna element is provided with its own phase shifter, limiter and low noise amplifier. A high-power transmitter is provided for each sub-array to eliminate the cost of high-powered amplifiers at each radiating element. In the receive mode, the antenna elements are coupled to a receive terminal by a low noise amplifier, phase shifter, and a duplexer. In the transmit mode, each antenna element is coupled directly to a transmit terminal by a phase shifter and a duplexer.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
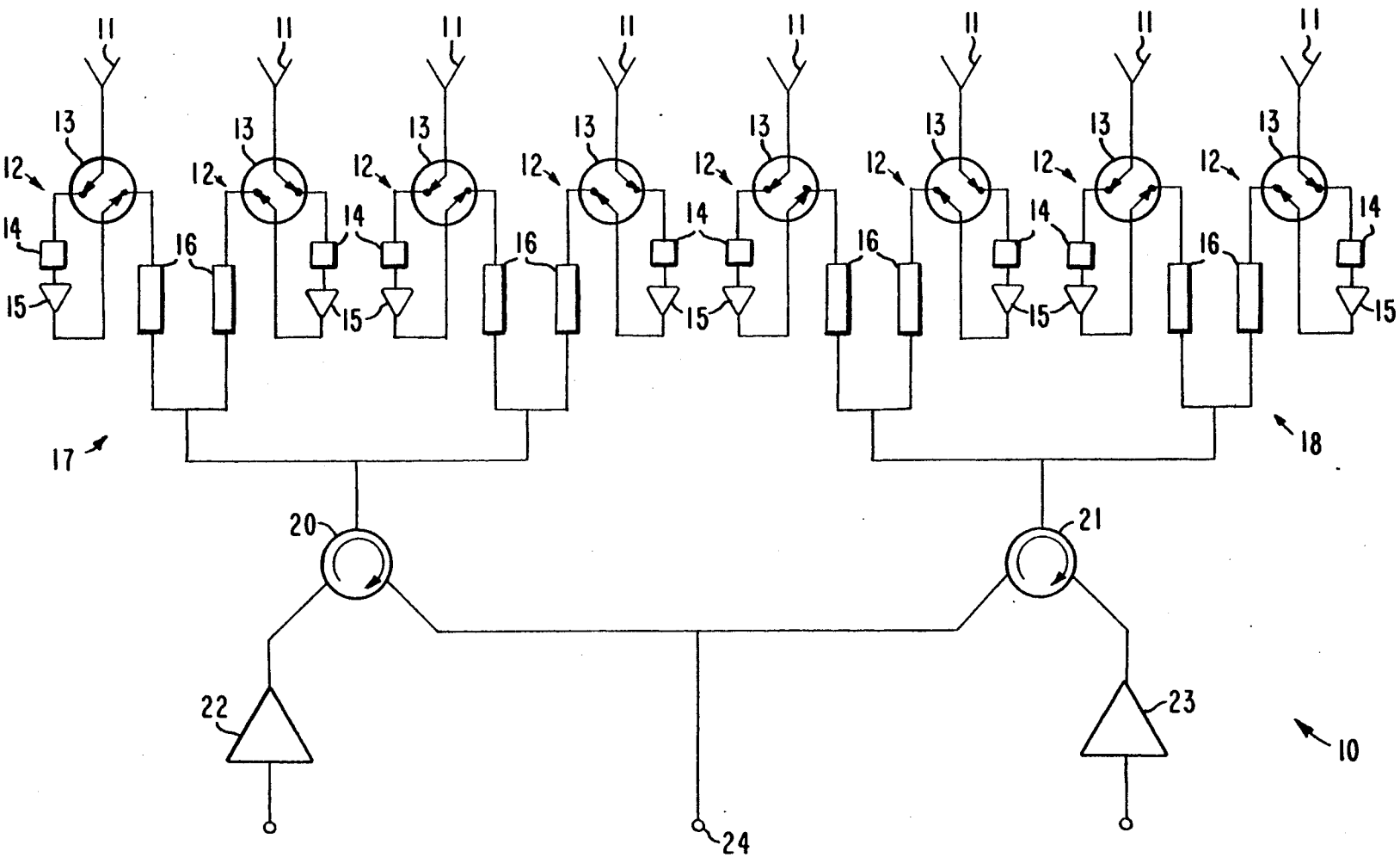
FIG. 1 is schematic diagram of an embodiment of a semi-active phased array antenna constructed in accordance with the invention employing double-pole-double-throw switches at each antenna element.

Referring now to FIG. 1 of the drawings, there is provided a semi-active phased array antenna 10 constructed in accordance with the invention. The semi-active phased array antenna 10 comprises a plurality of antenna elements 11 sometimes referred to as radiating elements 11, although it is to be understood that they are capable of both radiating and receiving. For convenience in describing the invention, only eight radiating elements 11 are shown in FIG. 1 but it is to be understood that the phased array antenna 10 may comprise many more elements 11 in actual practice.

Each element 11 has associated with it a semi-active module 12 comprising a DPDT (double-pole-double-throw) switch 13, a receiver limiter 14, a receiver low noise amplifier 15, and a phase shifter 16. Radiating elements 11 and their associated semi-active modules 12 are grouped into first and second sub-arrays 17, 18 and their phase-shifters 16 are connected to first and second duplexers 20, 21. That is, groups of semi-active modules 12 are connected together by a corporate feed network to form the sub-arrays 17, 18. First and second high power transmitter amplifiers 22, 23 are connected to the transmit ports of the first and second duplexers 20, 21. The high power transmitter amplifiers 22, 23 may be solid state power amplifiers or traveling wave tube amplifiers, if desired. The duplexers 20, 21 which separate the transmit and receive paths are ferrite circulators. Thus, one high power amplifier 22, 23 is provided for each sub-array 17, 18. This is less expensive than providing an amplifier 22, 23 for each antenna element 11, and has the added advantage of improving reliability in that a plurality of amplifiers 22, 23 is provided comparing to a single transmitter for the entire antenna as in the case of a conventional passive array antenna. The receive ports of the duplexers 20, 21 are connected together to form the receive beam at terminal 24.

In operation in the receive mode as illustrated in FIG. 1, the DPDT switch 13 switches the received signals from each element 11 to its limiter 14 and low noise amplifier 15. The amplified received signal then goes back through the DPDT switch 13 to the phase shifter 16 and then through one of the duplexers 20, 21 to the receive terminal 24. At this point the received signals are combined to form the required receive beam.

In the transmit mode, the DPDT switch 13 is switched to the transmit position and the transmit signal from each of the high power amplifiers 22, 23 goes to the transmit port of the first and second duplexers 20, 21 and out the antenna port to the first and second subarrays 17, 18. The transmit signal from the duplexers 20, 21 goes through the phase shifter 16 to the DPDT switch 13 and out to the radiating element 11.

Thus, the embodiment of the semi-active phased array antenna 10 shown in FIG. 1, employs the semi-active array module 12 as the basic building block in conjunction with a novel switching technique using the DPDT switches 13 to provide advantages in both transmit mode and receive mode. In the receive mode, it serves the purpose of bringing the low noise receiver front end close to the antenna element 11. Thus, with a low noise amplifier 15 provided at each element 11, the signal-to-noise ratio on receive is established close to the element 11. In the transmit mode, the low noise amplifier 15 is out of the transmit path. Rather than having a separate high power transmitting amplifier in the semi-active module 12, the embodiment of FIG. 1 provides separate high-power transmitter amplifiers 22, 23 for each of the sub-arrays 17, 18. This provides an adequate power level at each of the elements 11 while at the same time economizing on the cost that would be involved in having a separate amplifier for each element 11.

The performance of the semi-active phased array antenna 10 illustrated in FIG. 1, is dependent on the isolation characteristics of the DPDT switch 13 used as the T/R switch therein. In the embodiment of FIG. 1, the switch 13 is a double-pole-double-throw switch. Typically, the isolation of a DPDT switch is in the range of 40 dB to 50 dB. However, better isolation can be achieved by incorporating a ferrite circulator in the semi-active module 12 in place of the DPDT switch 13. Accordingly, referring now to FIG. 2 of the drawings there is shown an embodiment of a semi-active phased array antenna 30 having a semi-active module 31 employing a ferrite circulator 32 for performing the T/R switch function.

On transmit, a leakage signal can not couple to the low-noise amplifier 15 because it is circulated to a matched load termination 33. This embodiment of the semi-active phased array antenna 30 is provided with separate phase shifters 34, 35 for receive and transmit. On receive, the reflected signal from the receive phase shifter 34 is also circulated into the matched load termination 33. Hence, the radar cross-section of this semi-active phased array antenna 30 is smaller comparing to that of an array without the circulators at each radiating element. By employing separate receive and transmit phase shifters 34, 35 extremely good isolation between transmit and receive is achieved.

Figure 2:
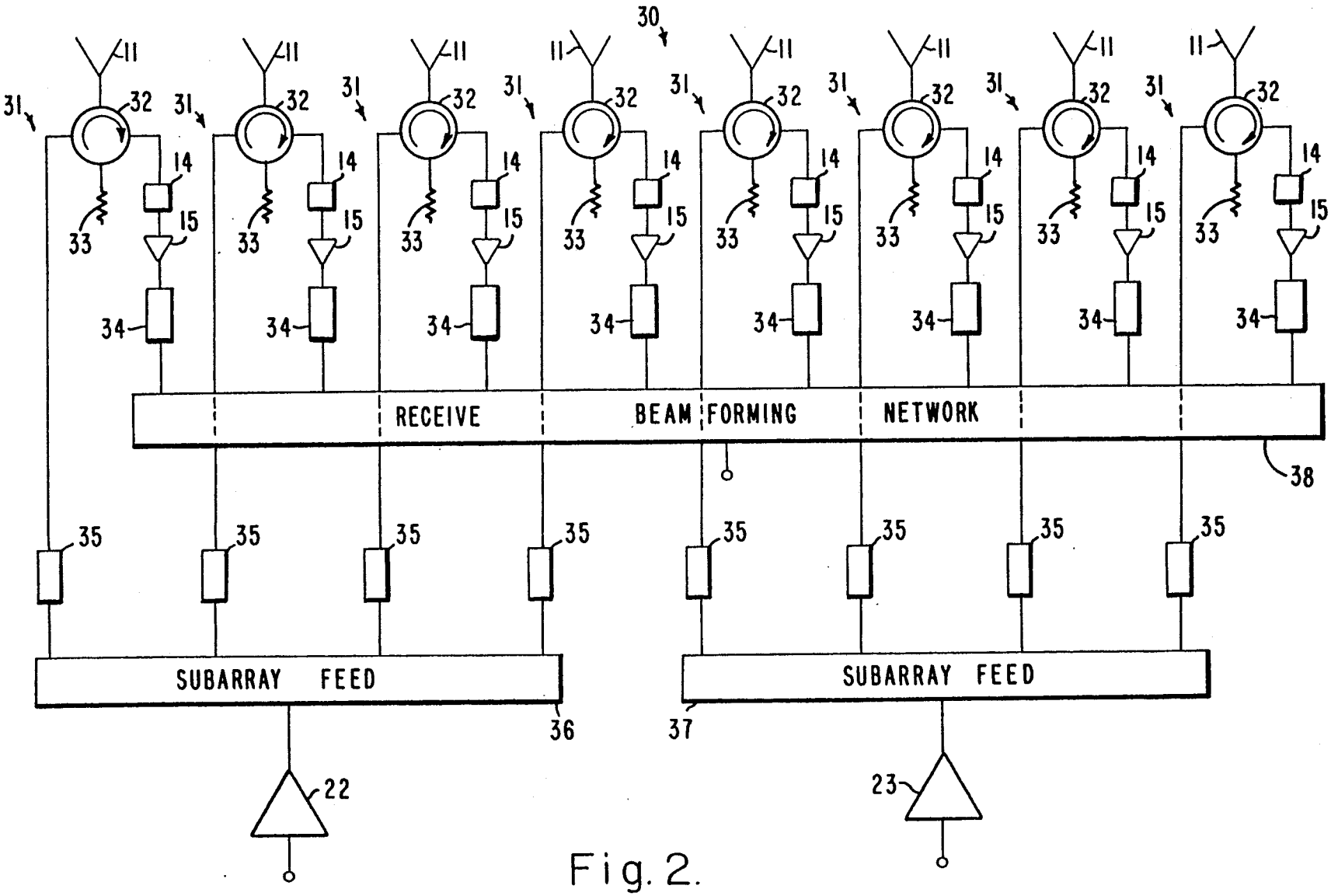
FIG. 2 is an embodiment of a semi-active phased array antenna in accordance with the invention employing ferrite circulators at each antenna element, and having separate phase shifters for transmit and receive.

In operation, the semi-active phased array antenna 30 shown in FIG. 2 uses four-port ferrite circulators 32 at each radiating element 11 to perform the duplexing function between transmit and receive. On transmit, the high power signal from the high power transmitter amplifiers 22, 23 is distributed by transmit sub-array feed networks 36, 37 to the transmit phase shifters 35. After the signal is appropriately phase shifted, it is fed into the radiating element 11 through the circulator 32.

On receive, the received signal from each radiating element 11 is circulated to the limiter 14 and the low-noise amplifier 15. After amplification, the received signal is phase-shifted appropriately in the receive phase shifter 34 before it is combined with the signals from all the other elements 11 in a receive beam forming network 38. In this embodiment, the signal-to-noise ratio is again established at the antenna element 11 and any losses in the receive phase shifter 34 and the receive beam forming network 38 are inconsequential.

Any reflected power from the radiating element 11 on transmit is reflected by the limiter 14 into the matched load termination 33 of the four-port circulator 32. Thus, the low-noise amplifier 15 is protected from the high reflected power on transmit. Furthermore, the four-port circulator 32 provides the extra isolation required between the transmit and receive paths.

The transmit phase shifters 35 may be incorporated into the sub-array feeds 36, 37, or if desired, they may be incorporated into the semi-active module 31. If desired, a separate single high-power transmitting amplifier may be used in place of the two high power transmitting amplifiers 22, 23, and the two sub-array feeds 36, 37 may be combined into a single transmit beam forming network corresponding to the single receive beam forming network 38 shown in FIG. 2. Furthermore, if desired the semi-active phased array antenna 30 may be employed in a monopulse radar system wherein the receive beam forming network 38 is a receive monopulse feed that provide sum and difference signals. The transmit feed may be adapted to include either a transmit ferrite phase shifter or a diode phase shifter to handle the required transmit power. This arrangement may be employed, for example, as a semi-active phased array antenna for the TPQ-36A air defense radar as the Ground Based Sensor (GBS) for the Forward Area Air Defense System (FAADS). In such a monopulse system, the radiating elements 11 are the preexisting slot arrays used in those systems. The semi-active module 31 is incorporated into a hybrid that may be used to insert elevation monopulse with only minor modifications to the antenna. This would double the number of targets the system can acquire and track in small azimuth sectors and would also increase the sensitivity by approximately 2½ dB. The modifications would involve the addition of 64 relatively low power waveguide circulators, 64 semi-active hybrid modules, and a stripline monopulse feed. The hybrid modules may include the receiver limiter, the low-noise amplifier, the receive phase shifter, driver and driver logic. The hybrid modules an monopulse feeds may be packaged in the existing antenna unit and the spare pedestal rotary joint may be used for the elevation difference channel.

Figure 3:
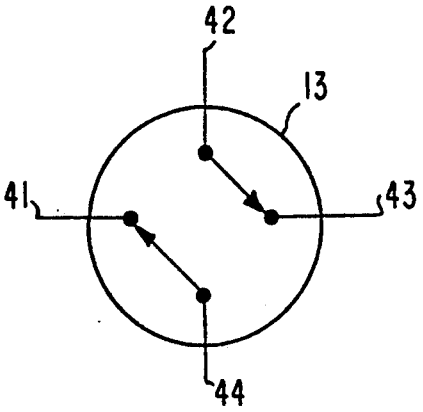
FIG. 3 illustrates a double-pole-double-throw switch such as is used in the phased array antenna in FIG. 1.

FIG. 3 illustrates schematically a double-pole-double-throw switch such as switch 13 used in the embodiment of the phased array antenna 10 illustrated in FIG. 1. Such switches 13 are well known to those skilled in the art. Referring to FIG. 3, terminal 42 may be switched to connect either to terminal 41 or terminal 43. Terminal 44 may also be switched to connect to those same terminals 41, 43, however, when terminal 42 is switched to terminal 43, terminal 44 is automatically switched to terminal 41, and vice versa. Thus, this arrangement permits use of a single phase shifter on both transmit and receive, and yet permits switching the receiver limiter and low noise amplifier out of the circuit on transmit.

DPDT switches 13 typically take the form of semiconductor diode switch arrangements employing four PIN diodes connected in a bridge circuit. In the PIN bridge, the anodes of two diodes connect to terminal 42, with the cathodes being connected to terminals 41 and 43. The anodes of the other two diodes connect to terminal 44, with the cathodes being connected to terminals 41 and 43. The diodes are physically arranged such that there is ¼ wavelength spacing at the frequency of operation between each diode and each of the terminals to which it is connected. The switching control voltages are applied across the diode bridge at terminals 41 and 43. Such a DPDT switch arrangement employing four PIN diodes in a bridge circuit is shown and described in U.S. Pat. No. 4,766,438 issued to Tang on Aug. 23, 1988 in connection with FIG. 8 thereof.

Figure 4:
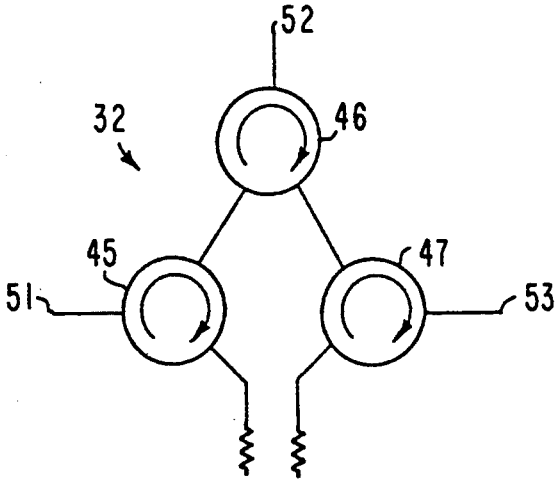
FIG. 4 shows a four port ferrite circulator formed from three three port circulators connected together.

Referring now to FIG. 4, there is shown a four-port circulator formed from three three-port circulators 45, 46, 47. This is for performing the T/R switch function of the ferrite circulator 32 in the semi-active phased array antenna 30 illustrated in FIG. 2. The four-port circulator 32 consists of three three-port circulators 45,

46, 47 connected together in a manner as shown in FIG. 4. Signal flows from port-to-port in the direction of the circulating arrows, as indicated in FIG. 4. For example, an input signal at port 51 circulates to port 52; likewise, signal input to port 52 appears at port 53, and so on.

The difference between the DPDT switch embodiment of FIG. 1 and the circulator embodiment of FIG. 2 is that the latter embodiment requires two sets of phase shifters (one for transmit and one for receive) and two sets of beamforming feed networks instead of one set as in the DPDT switch embodiment of FIG. 1. However, the two sets provide some extra degree of freedom in the independent adjustment of amplitude and phase distributions between the transmit and receive beams.

Figure 5:
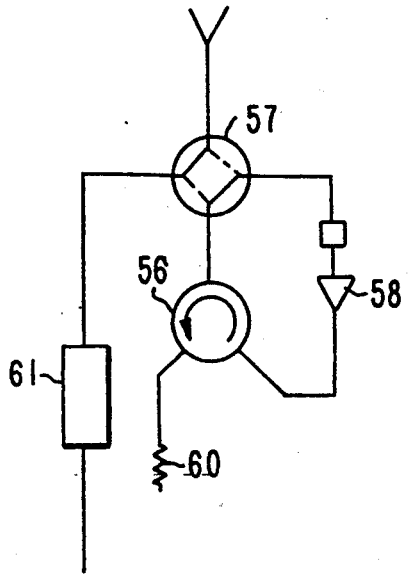
FIG. 5 illustrates a semi-active module for a constrained feed array that employs a ferrite circulator and a double-pole-double-throw switch.

Referring now to FIG. 5, there is illustrated a semi-active module for a constrained feed array that employs both a ferrite circulator 56 and a DPDT switch 57. The solid lines in the DPDT switch 57 indicate the transmit path, and the broken lines indicate the receive path. This arrangement provides additional isolation between receive and transmit. On transmit, the leakage signal cannot couple into the low-noise amplifier 58 since it is circulated into a matched load termination 60. On receive, the reflected signal from the phase shifter 61 is also circulated into the matched load termination 60. Hence, the isolation between receive and transmit is greatly improved.

Figure 6:
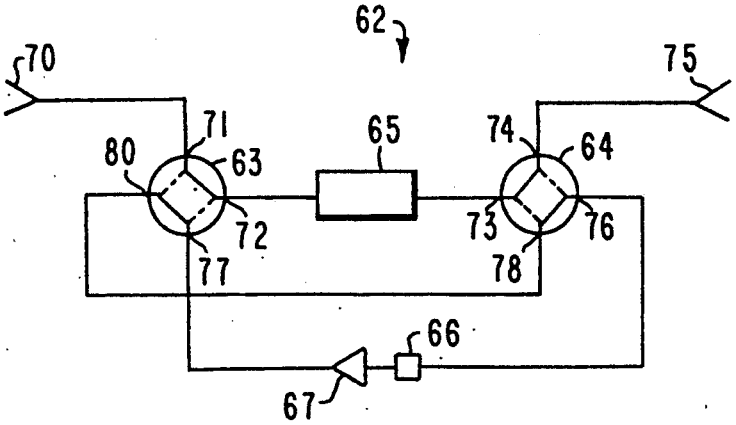
FIG. 6 illustrates a semi-active module for a space fed array.

The embodiments of a semi-active module illustrated in FIGS. 1, 2 and 5 are intended for use with a constrained feed. However, semi-active arrays may also be used with space feeds. Referring now to FIG. 6 of the drawings, there is illustrated a semi-active module 62 for a space fed array. The module 62 comprises two DPDT switches 63, 64, a phase shifter 65, a limiter 66, and a low-noise amplifier 67. A first antenna element 70 pointing in one direction is connected to terminal 71 of DPDT switch 63 which is switched in the transmit mode as indicated by the solid lines. A signal received by the antenna element 70 will pass through the DPDT switch 63 and exit by a terminal 72. The signal will pass through the phase-shifter 65 and enter DPDT switch 64 by a terminal 73. DPDT switch 64 is also switched to the transmit mode as indicated by the solid line and consequently the signal that enters on terminal 73 will exit via terminal 74 and be applied to a second antenna element 75 oriented in a different direction. Thus a signal received by antenna element 70 will pass through the module 62 via the phase-shifter 65 and be reradiated by the antenna element 75 pointed in a different direction.

When the two DPDT switches 63, 64 are switched to the receive mode as indicated by the broken lines, a signal received by antenna element 75 will pass through DPDT switch 64 from terminal 74 to terminal 76, through the limiter 66, low-noise amplifier 67 and enter DPDT switch 63 at terminal 77. The signal exits DPDT switch 63 at terminal 72, passes through the phase-shifter 65, enters DPDT switch 64 again, this time at terminal 73 and exits via terminal 78. The signal enters DPDT switch 63 again, this time at terminal 80 and exits at terminal 71 where it is applied to antenna element 70 and is reradiated in a different direction.

Module 62 may be adapted for receiving at antenna element 70 by switching DPDT switch 64 in a manner so that the receive path is from terminal 73 to 74 and from terminal 76 to 78. If that switching change is made, when a signal is received at element 70, it will enter DPDT switch 63 at terminal 71, exiting at terminal 80, pass to DPDT switch 64 where it will enter terminal 78 and exit via terminal 76. The signal will then pass through the limiter 66 and the low-noise amplifier 67, will reenter the DPDT switch 63 at terminal 77 exiting at terminal 72. The signal will then pass through the phase shifter 65 to the DPDT switch 64 where it reenters via terminal 73 exiting via terminal 74, where it is applied to the second antenna element 75 for re-radiation.

Thus there has been described several new and improved semi-active modules for use in semi-active phased array antennas which provides high power in transmit mode and a low noise figure in receive mode.

It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A semi-active phased array antenna having individual semi-active modules disposed adjacent individual antenna elements for selectively interconnecting the antenna elements with a single transmit/receive feed line in a first mode on transmit and in a second mode on receive, said modules comprising:

a receive circuit internal to said module including a limiter and a low noise amplifier;

a phase shifter disposed within said module;

a single transmit/receive feed line connected to one end of said phase shifter; and switch means in said module connected to the other end of said phase shifter and connected to its associated antenna element and arranged to selectively switch between said first and second modes, said switch means connecting its associated antenna element to said feed line by way of said phase shifter on transmit, said switch means connecting its associated antenna element to said feed line by way of said receive circuit and said phase shifter on receive;

whereby said phase shifter is included in the circuit from said antenna element to said transmit/receive feed line both on transmit and receive, and whereby said limiter and said low noise amplifier are bypassed on transmit.

2. The semi-active module of claim 1 in which said switch means comprises a DPDT switch.

3. The semi-active module of claim 1 in which said switch means comprises a ferrite circulator.

4. The semi-active module of claim 1 in which said switch means comprises an arrangement including a DPDT switch and a ferrite circulator.

5. The semi-active phased array antenna of claim 1 further comprising a plurality of ferrite circulator duplexers coupled to the transmit/receive feed line of each of said modules.

6. The semi-active phased array antenna of claim 5 further comprising a plurality of high-power transmitter amplifiers.

7. A semi-active phased array antenna having individual semi-active modules disposed adjacent individual antenna elements, said semi-active modules comprising:

a receive circuit internal to said module including a limiter and a low noise amplifier and a receive phase shifter, said receive phase shifter having an output connected to a receive beamforming network;

a transmit phase shifter having an input connected to a feed and an output;

switch means in said module comprising a four-port circulator, said four-port circulator being directly connected to the output of said transmit phase shifter and arranged to selectively switch between said receive circuit in a receive mode and said transmit phase shifter in a transmit mode, said four-port circulator coupling its associated antenna element to said feed by way of said transmit phase shifter on transmit, said four-port circulator coupling its associated antenna element to said receive beamforming network by way of said receive circuit on receive.

8. The semi-active phased array antenna of claim 7 wherein the feed comprises a transmit beamforming network.

9. The semi-active phased array antenna of claim 7 wherein said receive beamforming network comprises a monopulse feed and said feed comprises a transmit series feed having a ferrite phase shifter.

10. A semi-active phased array antenna, including antenna elements and associated phase shifters adapted to provide high power in transmit mode and low noise figure in receive mode comprising:

a plurality of high-power transmitter amplifiers;

a plurality of duplexers, each duplexer being associated with a subarray of said antenna elements for switching each individual subarray from an individual one of said high-power transmitter amplifiers to a signal receive terminal;

a plurality of receive paths, including limiters and low noise amplifiers; and a plurality of T/R switches having a transmit state and a receive state, said switches being coupled to said antenna elements, to said phase shifters, and to said receive paths such that in the receive state, said antenna elements are coupled to said receive terminal via a receive path, a phase shifter and a duplexer, and in the transmit state, said antenna elements are coupled directly to a high-power transmitter amplifier via a phase shifter and a duplexer.

11. The semi-active phased array antenna of claim 10 in which said T/R switches are double-pole-double-throw switches.

12. The semi-active phased array antenna of claim 11 in which said double-pole-double-throw switch has a first switch pole connected to one of said antenna elements, said first switch pole being adapted for switching from a first switch terminal to a second switch terminal, said double-pole-double-throw switch having a second switch pole for switching from said second switch terminal to said first switch terminal; said receive path having the input of said limiter connected to the first switch terminal of said first switch pole, said receive path having the output of the low-noise amplifier connected to said second switch pole, said second switch terminal being connected to one terminal of said phase shifter, the other terminal of said phase shifter being connected to its associated duplexer.

13. The semi-active phase array antenna of claim 12 in which said duplexers comprise ferrite circulators.

14. A semi-active phased array antenna using four-port circulators to provide high power in transmit mode and low noise figure in receive mode, said semi-active phased array antenna comprising:

a plurality of four-port circulators;

a plurality of transmit phase shifters having an output connected to a first port of said circulators;

a plurality of antenna elements connected to a second port of said circulators;

a plurality of receiver limiters having an input connected to a third port of said circulators;

a plurality of matched load terminations connected to a fourth port of said circulators;

a plurality of low-noise amplifiers having an input connected to the output of said limiters;

a plurality of receive phase shifters connected to the output of said amplifiers;

a receive beamforming network connected to the output of each of said receive phase shifters for combining the output received signals into a received beam;

a plurality of high-power transmitter amplifiers; and a plurality of subarray feeds, each being connected to an individual one of said transmitter amplifiers, and each of said subarray feeds being connected to the input of different groups of said transmit phase shifters.

15. The semi-active phased array antenna of claim 14 in which said four-port circulators comprise three three-port circulators connected together to function as a four-port circulator.

16. The semi-active phased array antenna of claim 14 in which said high-power transmitter amplifiers comprise traveling wave tube amplifiers.

17. The semi-active phased array antenna of claim 14 in which said high-power transmitter amplifiers comprise high-power solid state amplifiers.

18. Apparatus for coupling an antenna element of a constrained feed phased array antenna to a transmit/-receive feed while providing enhanced isolation between transmit and receive, said apparatus comprising:

a semi-active module having a transmit/receive input/output terminal, and having an antenna element input/output terminal;

a double-pole-double-throw switch disposed in said module and having a first switch pole connected to said antenna element input/output terminal, said first switch pole being adapted for switching from a first switch terminal to a second switch terminal;

said double-pole-double-throw switch having a second switch pole for switching from said second switch terminal to said first switch terminal;

a receiver limiter disposed in said module and having an input connected to said second switch terminal;

a receiver low noise amplifier disposed in said module and having an input connected to the output of said limiter;

a three-port ferrite circulator disposed in said module and having a first port connected to said second switch pole, said circulator having a second port connected to the output of said amplifier;

a matched load termination disposed in said module and connected to a third port of said circulator; and a phase shifter disposed in said module and connected from said first switch terminal to said transmit/-receive input/output terminal, whereby an operative semi-active phased array antenna is formed by coupling a plurality of said antenna elements to a transmit/receive feed through a plurality of said semi-active modules.

19. A semi-active module arrangement for a space-fed antenna array comprising:

a semi-active module having first and second antenna element terminals;

first and second DPDT switches disposed in said module, each having a first switch pole for switching from a first switch terminal to a second switch terminal, and each having a second switch pole for switching from said second switch terminal to said first switch terminal;

said first DPDT switch having its first switch pole connected to said first antenna element terminal;

said second DPDT switch having its first switch pole connected to said second antenna element terminal;

a phase shifter disposed in said module and being connected between the second switch terminal of said first DPDT switch and the first switch terminal of said second DPDT switch;

a receiver limiter disposed in said module and having an input connected to the second switch terminal of said second DPDT switch; and a receiver low noise amplifier disposed in said module and having an input connected to the output of said limiter, and having its output connected to the second switch pole of said first DPDT switch;

the second switch pole of said second DPDT switch being connected to the first switch terminal of said first DPDT switch;

whereby a signal entering said second antenna element terminal is switched to pass through said limiter, said amplifier and said phase shifter and is conducted to said first antenna element terminal.

20. The semi-active phased array antenna of claim 7 wherein the feed comprises a subarray feed.

21. A semi-active phased array antenna having individual semi-active modules disposed adjacent individual antenna elements, said semi-active modules comprising:

a receive circuit internal to said module including a limiter and a low noise amplifier and a receive phase shifter, said receive phase shifter having an output connected to a receive beamforming network, wherein said receive beamforming network comprises a monopulse feed and said feed comprises a transmit series feed having a ferrite phase shifter;

a transmit phase shifter having an input connected to a feed;

switch means in said module comprising a four-port circulator, said four-port circulator connected to said transmit phase shifter and arranged to selectively switch between said receive circuit in a receive mode and said transmit phase shifter in a transmit mode, said four-port circulator coupling its associated antenna element to said feed by way of said transmit phase shifter on transmit, said four-port circulator coupling its associated antenna element to said receive beamforming network by way of said receive circuit on receive.

22. The semi-active phased array antenna of claim 21 wherein the feed comprises a subarray feed.

23. The semi-active phased array antenna of claim 7 wherein the feed comprises a transmit beamforming network.

24. The semi-active phased array antenna of claim 7 wherein said receive beamforming network comprises a monopulse feed and said feed comprises a transmit series feed having a ferrite phase shifter.

* * * * *